US009745112B2

(12) United States Patent
Bellmore et al.

(10) Patent No.: US 9,745,112 B2
(45) Date of Patent: Aug. 29, 2017

(54) DISPENSING BAG HAVING A HOSE SPOUT

(71) Applicant: Scholle Corporation, Irvine, CA (US)

(72) Inventors: David Bellmore, DeWitt, MI (US); Chris Murray, Chicago, IL (US)

(73) Assignee: Scholle IPN Corporation, Northlake, IL (US)

( * ) Notice: Subject to any disclaimer, the term of this patent is extended or adjusted under 35 U.S.C. 154(b) by 0 days.

(21) Appl. No.: 14/535,211

(22) Filed: Nov. 6, 2014

(65) Prior Publication Data

US 2015/0129612 A1 May 14, 2015

Related U.S. Application Data

(60) Provisional application No. 61/915,003, filed on Dec. 12, 2013, provisional application No. 61/900,780, filed on Nov. 6, 2013.

(51) Int. Cl.
*B65D 35/56* (2006.01)
*B65D 77/06* (2006.01)

(52) U.S. Cl.
CPC ..... *B65D 77/065* (2013.01)

(58) Field of Classification Search
CPC ..... B65D 77/065
USPC ..... 222/105
See application file for complete search history.

(56) References Cited

U.S. PATENT DOCUMENTS 2,815,887 A * 12/1957 Ford ..... B65D 25/14 220/495.06
2,831,610 A * 4/1958 Dennie ..... B65D 5/5059 222/105
2,861,718 A * 11/1958 Winzen ..... B65D 75/5816 222/105
2,905,560 A * 9/1959 Bender ..... A01J 9/00 141/65
3,081,911 A * 3/1963 Scholle ..... B65D 77/065 222/105
3,117,695 A * 1/1964 Cox, Jr. ..... B65D 75/5872 222/105
3,123,254 A * 3/1964 Rabby ..... B65D 77/065 222/105
3,138,293 A * 6/1964 Roak ..... B65D 75/5816 222/105
3,178,063 A * 4/1965 Cox, Jr. ..... B65B 3/045 222/105
3,178,064 A * 4/1965 Layne ..... B65D 5/701 222/105
3,204,825 A * 9/1965 Underwood ..... B65D 31/02 222/105

(Continued)

*Primary Examiner* — Patrick M Buechner
*Assistant Examiner* — Michael J Melaragno
(74) *Attorney, Agent, or Firm* — The Watson I.P. Group, PLC; Jovan N. Jovanovic; Vladan M. Vasiljevic

(57) ABSTRACT

A flexible package having dispensing bag and a hose spout integrally coupled therewith. The dispensing bag is positioned within an outer vessel or urn having a valve dispensing member. The hose spout is extended through the valve dispensing member. The filled container can be emptied through the hose spout, which dispensing fluid flow can be controlled by the valve dispensing member. The hose spout comprises a molded member that includes a base flange that extends through a transition region to an elongated spout, with a dispensing opening at a distal end of the elongated spout.

19 Claims, 4 Drawing Sheets

(56) References Cited

U.S. PATENT DOCUMENTS 3,318,505 A * 5/1967 Speas ..... B65D 25/42 222/105
3,895,742 A * 7/1975 Wulbern ..... B65D 83/0055 222/105
3,908,864 A * 9/1975 Capper ..... B65D 77/065 222/105
3,976,277 A * 8/1976 Basel ..... F16K 7/06 222/529
4,274,554 A * 6/1981 Malpas ..... B65D 77/065 222/107
4,381,846 A * 5/1983 Heck ..... B65D 77/067 222/105
4,516,693 A * 5/1985 Gaston ..... B65D 77/06 222/105
RE32,354 E * 2/1987 Savage ..... B65D 77/067 141/349
4,907,724 A * 3/1990 Wing, Jr. ..... B65D 77/283 206/525
5,064,096 A * 11/1991 Illing ..... B65D 77/061 222/105
5,265,766 A * 11/1993 Kurtzahn ..... B65D 77/06 141/18
5,803,317 A * 9/1998 Wheeler ..... B67D 1/0004 222/105
5,887,626 A * 3/1999 Hugo ..... B65D 77/065 138/119
6,012,611 A * 1/2000 Schroeder ..... B65D 77/065 222/105
6,024,252 A * 2/2000 Clyde ..... B67D 3/041 222/105
6,053,360 A * 4/2000 Rutter ..... A61J 1/10 222/1
6,116,467 A * 9/2000 Petriekis ..... B65D 77/06 141/114
6,186,361 B1 * 2/2001 Teetsel, III ..... B67B 7/26 222/1
6,712,241 B1 * 3/2004 Garcia ..... B05B 11/0043 222/105
6,883,683 B1 * 4/2005 Cunningham ..... B65D 75/58 222/107
6,962,275 B2 * 11/2005 deCler ..... B65D 5/746 222/105
8,657,163 B2 * 2/2014 Eriksson ..... B65D 77/068 222/105
2006/0091154 A1 * 5/2006 Light ..... B65D 77/065 222/105
2007/0217719 A1 * 9/2007 Smith ..... B65D 77/062 383/66
2008/0083777 A1 * 4/2008 Lips ..... B65D 77/067 222/105
2010/0200613 A1 * 8/2010 Smith ..... B67D 3/0054 222/105
2015/0122844 A1 5/2015 Klein et al.
2015/0359379 A1 12/2015 Peterson et al.
2016/0068382 A1 3/2016 Peterson et al.

* cited by examiner

DISPENSING BAG HAVING A HOSE SPOUT

CROSS-REFERENCE TO RELATED APPLICATION

This application is related to U.S. Prov. Pat. App. Ser. No. 61/900,780 filed Nov. 6, 2013 entitled "Dispensing Bag Having A Hose Spout," and U.S. Prov. Pat. App. Ser. No. 61/915,003 filed Dec. 12, 2013, entitled "Dispensing Bag Having A Hose Spout", the entire disclosure of each of which is hereby incorporated in its entirety.

BACKGROUND OF THE DISCLOSURE

1. Field of the Disclosure

The invention relates in general to flexible packaging, and more particularly, to a flexible package having a dispensing bag with a hose spout which can be positioned within a generally rigid outer vessel or urn having a valve, wherein, the hose spout extends through the valve. Such a configuration precludes contact between the outer vessel and the liquid within the bag.

2. Background Art

It has become commonplace to offer iced tea and other non-carbonated beverages to customers at fast food and premium fast food restaurants. For example, many establishments have a large vessel positioned typically on a counter. The vessel has a tap that extends from the vessel for purposes of dispensing. The vessel is filled with a drink, typically a non-carbonated beverage such as iced tea, sweet tea, lemonade, etc. The user can selectively dispense the fluid from the vessel through the valve.

Problematically, when the vessel is emptied, it is typically required to be cleaned and refilled. It is often difficult to properly clean the vessel and the valve. Many times, later drinks are contaminated with either the prior contents of the vessel, bacteria or other debris that has accumulated within the vessel.

Certain solutions have been developed to minimize the need to wash and prepare the vessel for each subsequent refilling and use. For example, one solution is disclosed in U.S. Pat. No. 4,516,693 issued to Gaston. Such a solution relies upon a modified liner that has a spout that is formed from the liner material itself. Such a solution is difficult to properly position and use due to the natural characteristics of the liner material when formed into a spout.

Another solution is disclosed in U.S. Pat. No. 6,116,467 as well as U.S. Pat. App. Pub. Nos. 2010/0200613 and 2013/0037568. These publications disclose a bag having a spout that comprises a multi component spout. Such spouts generally include multiple components that require assembly and which are prone to failure or degradation due to the connections between the bag and the components of different rigidity. Each of the foregoing publications and issued patent are incorporated in their entirety herein.

SUMMARY OF THE DISCLOSURE

The disclosure is directed to a flexible package for positionable within a vessel having an outlet controlled by a valve dispensing member. The flexible package comprises a dispensing bag and a hose spout. The dispensing bag includes at least one panel and at least one seal defining a cavity with an open top, and an opening extending through the at least one panel spaced apart from the open top. The hose spout includes an integrally molded flange and elongated spout extending from the molded flange and together defining an elongated channel with a proximal end and a distal end. The proximal end corresponds to the molded flange. The molded flange has an inner surface, the inner surface is coupled to the dispensing bag in sealed engagement about the opening thereof.

In some configurations, the hose spout comprises a material of rigidity greater than that of the at least one panel. This, in turn, facilitates the extension of the hose spout through a valve dispensing member.

In some configurations, the dispensing bag includes a front panel and a back panel which are coupled together through by way of the at least one seal. The open top is defined by opposing edges of the front panel and the back panel.

In some configurations, the front panel and the back panel comprises generally rectangular configurations. The at least one seal includes a first side seal, a second side seal opposite the first side seal and a bottom seal extending between the first side seal and the second side seal. The open top is defined by the front panel and the back panel between the first side seal and the second side seal opposite the bottom seal.

In some configurations, the opening is positioned between the open top and the bottom seal on the front panel, closer to the bottom seal than the open top.

In some configurations, the inner surface of the integrally molded flange is positioned entirely on the front panel.

In some configurations, the elongated spout extends substantially perpendicularly from the molded flange and substantially perpendicular from the front panel of the dispensing bag, when the dispensing bag is positioned on the back panel, that is, in a generally lie flat orientation as is shown in FIG. 1.

In some configurations, the distal end of the elongated channel defined by the elongated spout defines a peak region, that is configured to form a guide upon insertion of the elongated spout through a valve dispensing.

In some configurations, the distal end is formed at an oblique angle relative to an axis of the elongated spout.

In some configurations, the distal end further includes a valley region opposite the peak region, and sides extending therebetween.

In some configurations, the peak region is aligned with the top opening of the flexible bag.

In some configurations, a transition region between the flange and the elongated spout. The elongated spout has a substantially circular cross-sectional configuration.

In some configurations, the flange of the spout is coupled directly to the at least one panel of the dispensing bag.

In another aspect of the disclosure, the disclosure is directed to a combination urn and flexible package. The combination includes a urn that includes an upper edge defining an opening, and an inner cavity. A valve dispensing member provides fluid communication to the inner cavity spaced apart from the opening toward a lower portion of the urn. The valve dispensing member includes an elongated opening. The flexible package includes a dispensing bag and a hose spout. The dispensing bag includes at least one panel and at least one seal defining a cavity with an open top. An opening extends through the at least one panel spaced apart from the open top. The hose spout includes an integrally molded flange and elongated spout extending from the molded flange. Together these define an elongated channel with a proximal end and a distal end. The proximal end corresponds to the molded flange. The molded flange has an inner surface. The inner surface is coupled to the dispensing bag in sealed engagement about the opening thereof. The elongated spout of the hose spout is directed through the elongated opening of the urn upon positioning of the flexible package within the inner cavity of the urn, with the open top of the flexible package corresponding to the opening of the urn.

In some configurations, the open top of the flexible package is extended above and over the upper edge of the urn.

In some configurations, the elongated spout further includes a peak region at the distal end thereof. The peak region is configured to direct the elongated spout through the elongated opening of the valve dispensing member.

In some configurations, the peak region is configured to facilitate the rotation of the elongated spout relative to the elongated opening of the valve dispensing member.

In some configurations, the hose spout is coupled directly to the dispensing bag.

In some configurations, the hose spout is formed from a first material and the dispensing bag is formed from a second material. The second material is different from the first material.

BRIEF DESCRIPTION OF THE DRAWINGS

The disclosure will now be described with reference to the drawings wherein.

DETAILED DESCRIPTION OF THE DISCLOSURE

Figure 3:
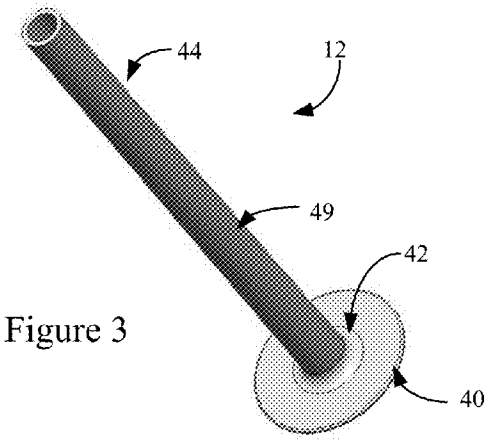
FIG. 3 of the drawings is a perspective view of the hose spout of the present disclosure.
Figure 4:
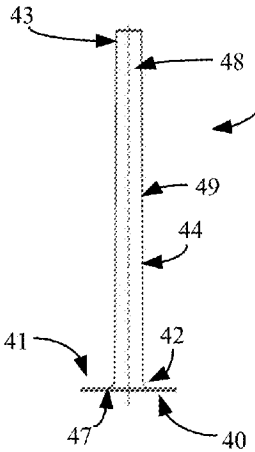
FIG. 4 of the drawings is a side elevational view of the hose spout of the present disclosure.

While this invention is susceptible of embodiment in many different forms, there is shown in the drawings and described herein in detail a specific embodiment with the understanding that the present disclosure is to be considered as an exemplification and is not intended to be limited to the embodiment illustrated.

It will be understood that like or analogous elements and/or components, referred to herein, may be identified throughout the drawings by like reference characters. In addition, it will be understood that the drawings are merely schematic representations of the invention, and some of the components may have been distorted from actual scale for purposes of pictorial clarity.

Figure 1:
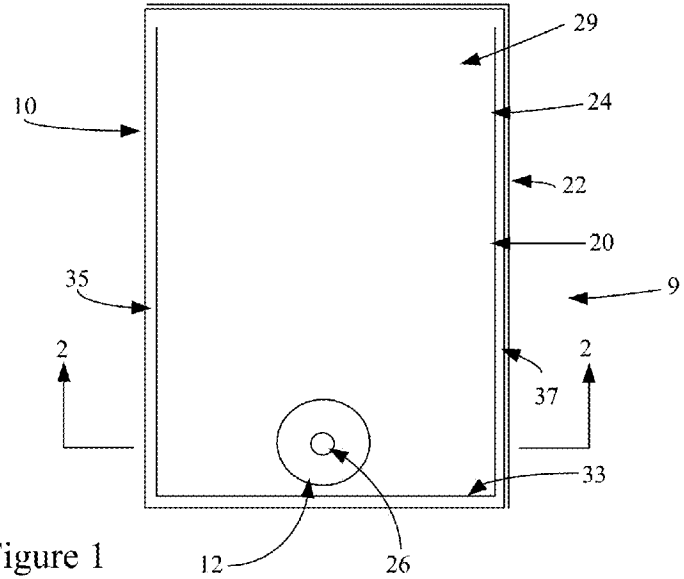
FIG. 1 of the drawings is a front elevated view of the dispensing bag and hose spout of the present disclosure.
Figure 7:
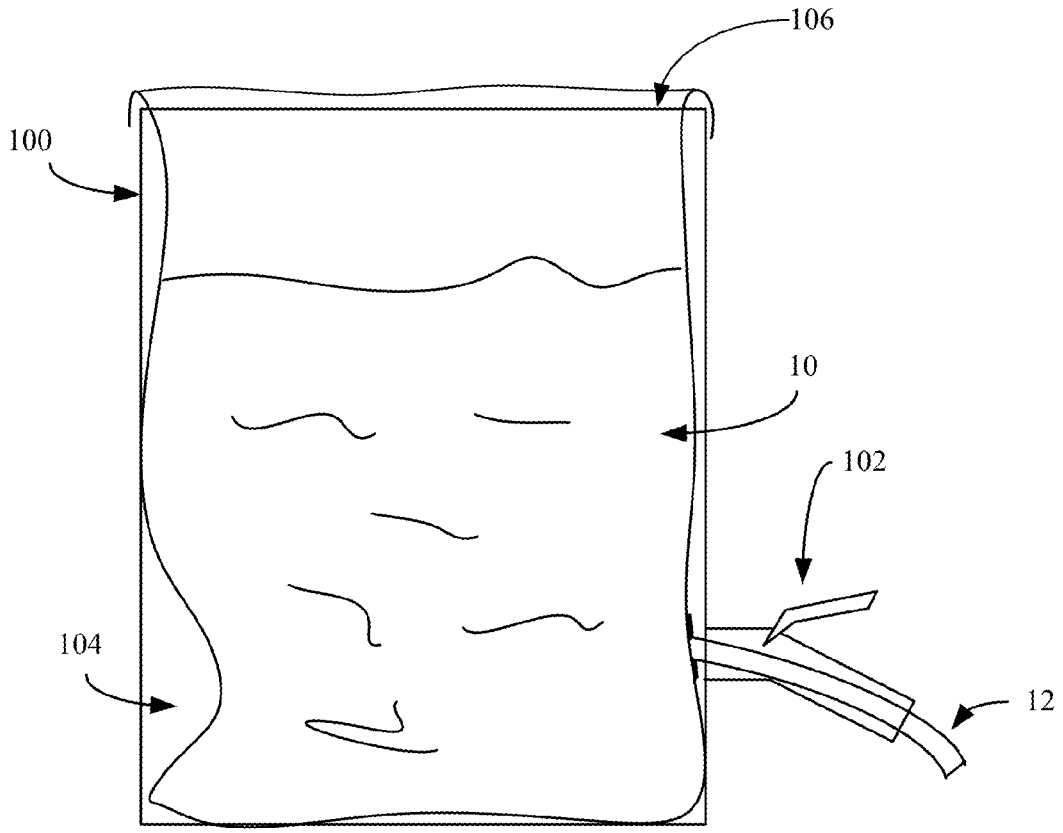
FIG. 7 of the drawings is a schematic representation of the dispensing bag and hose spout of the present disclosure positioned within a vessel or urn with a valve dispensing member.

Referring now to the drawings and in particular to FIG. 1, the disclosure is directed to a dispensing bag 10 having a hose spout 12 coupled thereto which defines a flexible package 9. The hose spout is integrally coupled to the dispensing bag. The dispensing bag is positioned within an outer vessel or urn, such as urn 100 (FIG. 7) having a valve dispensing member 102 (FIG. 7). The hose spout 12 is extended through the valve dispensing member 102. The filled container can be emptied through the hose spout 12, which dispensing fluid flow can be controlled by the valve dispensing member 102. As will be explained below, such a container is useful for the dispensing of, for example, brewed iced tea, lemonade or the like (generally non-carbonated beverages). Of course, the disclosure is not limited to the foregoing, but, can be utilized in association with any number of different fluids and flowable materials. It is contemplated that such a flowable material may comprise any number of different viscosities, and may include a solids content. The foregoing examples of flowable material are meant to be illustrative, and not deemed to be limiting.

Figure 2:
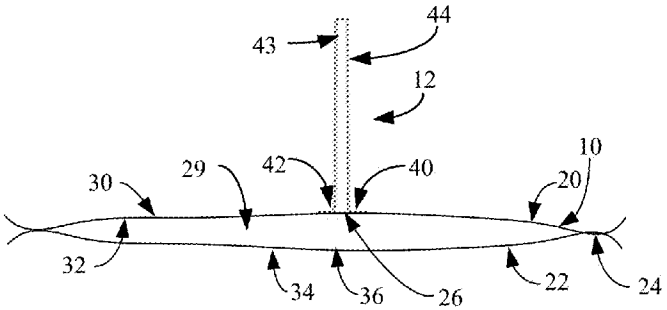
FIG. 2 of the drawings is a cross-sectional view of the dispensing bag and hose spout of the present disclosure taken generally about lines 2-2 of FIG. 1.

One illustrative dispensing bag is shown in FIGS. 1 and 2 as comprising an open top pillow type bag. Such a bag includes front panel 20 and back panel 22. Front panel 20 includes outer surface 30 and inner surface 32. The back panel 22 includes outer surface 34 and inner surface 36. The front and back panel are positioned in an overlying orientation so that the inner surfaces face each other. Generally, the two panels are co-extent and generally identically dimensioned, although such a relationship is not required. Generally, such a configuration is a single ply, although multiple ply containers are likewise contemplated. In addition, it is contemplated that the pillow type bag may comprise any number of different laminated and coextruded film structures, or combinations thereof.

The panels are then coupled together by way of seals 24. In the case of a pillow type container, the seals 24 include bottom seal 33, first side seal 35 and second side seal 37. The seals are generally perpendicular to adjacent seals and parallel to opposing seals to generally define an open top square or rectangular configuration, thereby defining a generally square or rectangular cavity 29, again with an open top. The seals may be formed through the application of heat, or through other procedures, including, but not limited to RF welding, ultrasonic welding, adhesive, among others. The disclosure is not limited to any particular manner of attachment of the panels. It will also be understood that while a rectangular configuration is contemplated, a number of different configurations are contemplated, including, but not limited to trapezoidal configurations, parallelograms, and the like. The configuration of the panels and the seals is not limited to the parallel and perpendicular relationship disclosed herein.

It is contemplated that in certain embodiments, a top seal may be provided which can be removed by cutting just below the top seal from the first side seal 35 to the second side seal 37. In such a configuration, a cavity 29 can be provided in a sterilized manner which sterilization is only affected when the top is cut (effectively turning the bag into an open top bag. In other embodiments, a perforation may be provided generally parallel to the top seal and spaced apart therefrom to assist with such a cut. In other embodiments, a starting notch may be positioned, wherein the bag is configured to rip along a line that is generally parallel to top seal.

Referring again to FIGS. 1 and 2, the bag 10 further includes opening 26 provided through the front panel 20 proximate, but spaced apart from the bottom seal 33. Hose spout 12 is placed in fluid communication with the opening 26, as will be disclosed below. In addition, a welding region is defined around opening 26.

Hose spout 12 is shown in FIGS. 2 through 6*b* as comprising a monolithic member having an inside surface 47 and an outside surface 49. Generally, the hose spout comprises a flexible injection molded member, although other constructions are contemplated. While a number of different polymer materials are contemplated, such as, for example, a styrene ethylene butylene styrene (SEBS) material, a styrene butadiene styrene (SBS) material, urethanes, among others, all of which provide a flexibility but with a rigidity that is greater than the flexible bag at the thickness of the bag relative to the spout (the rigidity being sufficient to direct the hose spout through a valve dispensing member). The particular material from which the hose is made is not limiting, as long as the hose and the bag are of compatible materials which can be coupled together to in a sealed fashion, or through an intermediary. That is, the hose spout, through the base flange 40 is coupled to the region around opening 26, either directly through welding, adhering, sealing, among other solutions, or indirectly through a intermediate component which is compatible with each (i.e., a film structure or the like). The resulting bag is formed from the hose spout being coupled to the bag so as to form an integrated combination. Generally, the separation of the hose spout from the bag is a destructive process due to the attachment of one to the other.

The hose spout 12 includes base flange 40, transition region 42 and elongated spout 44. The flange generally comprises a substantially uniformly thick member (with a thickness of between 0.5 mm to 3 mm, and more preferably about 0.70 and 0.90 mm) having a diameter of, for example, between 10 and 50 mm, and more preferably between 30 and 40 mm), although smaller and larger flanges are contemplated. The inside surface of the flange includes an attachment surface which is configured to attach to the welding region around opening 26. In the embodiment shown, the base flange is generally planar, although, it is contemplated that the base flange may be conical in configuration, or that it may follow a particular contoured configuration for a particular application (so as to fit into a particularly configured vessel/valve configuration). It will be understood that the base flange of the hose spout can be heat sealed, adhered, or otherwise attached to the outside surface of the bag about the welding region so as to provide a fluid tight bond therebetween.

The elongated spout 44 generally extends perpendicularly from the base flange 40 with a transition region 42 spanning therebetween, so as to insure the transition from the flange to the spout. The transition region may have an increased thickness as it transitions from the flange to the elongated spout, and may have a filleted radius of approximately 1 to 4 mm, and more preferably about 3 mm. It will be understood that these structures define elongated channel 48 therein. It is contemplated that the spout is between 100 mm and 250 mm and more preferably between 120 and 150 mm. Of course, other dimensions are likewise contemplated. It is contemplated that the diameter of the elongated spout is between 8 mm and 11 mm, and more preferably about 9.3 mm. The elongated channel has a diameter of approximately 6.9 mm in such a configuration leading to a wall thickness of approximately 2.4 mm. The elongated spout may also be oblique to the flange (such that it is angled at a particular angle. The elongated spout may comprises a generally linear configuration (although the flexibility of the material will tend to bend under force, such as the force of gravity). It is also contemplated that the elongated spout may be molded into a curved or segmented configuration when in an unstressed state. The elongated spout may be slightly inwardly tapered along the length thereof between proximal end 41 and distal end 43. It will be understood that in other embodiments, the cross-sectional configuration may be uniform along the length thereof, or may be varied by providing different elongated channel cross sectional area, shape, as well as different wall thicknesses of the elongated spout.

Figure 5A:
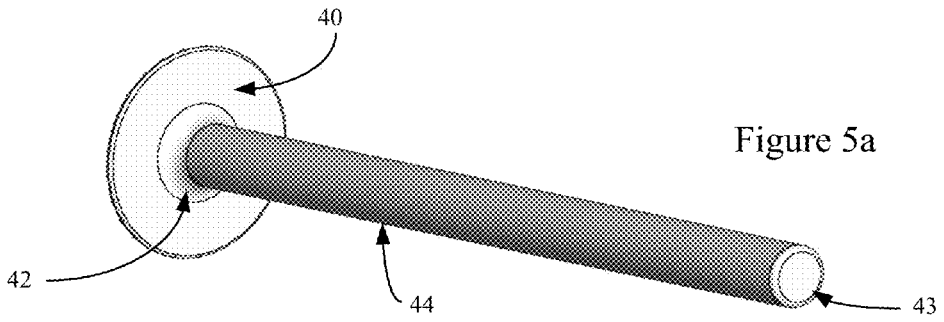
FIG. 5*a* of the drawings is a perspective view of a hose spout of the present disclosure.
Figure 5B:
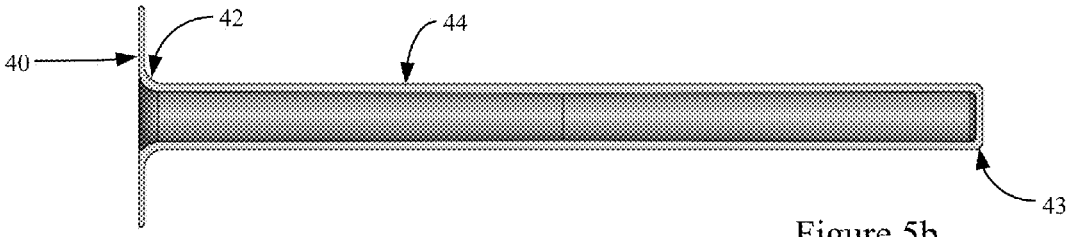
FIG. 5*b* of the drawing is a cross-sectional view of the hose spout of FIG. 5*a;*
Figure 6A:
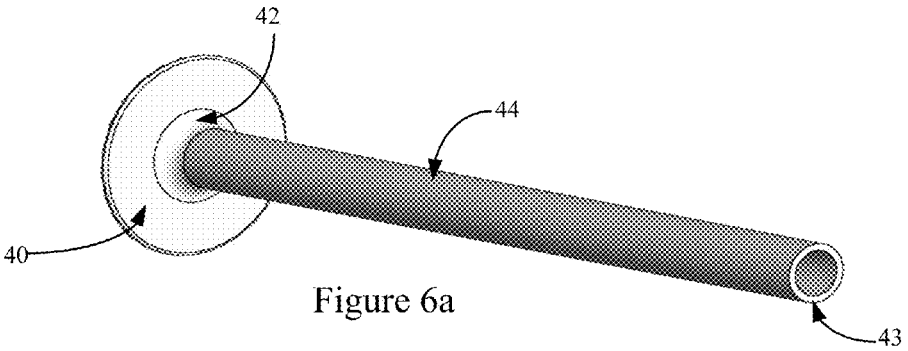
FIG. 6*a* of the drawings is a side elevational view of the hose spout of the present disclosure.
Figure 6B:
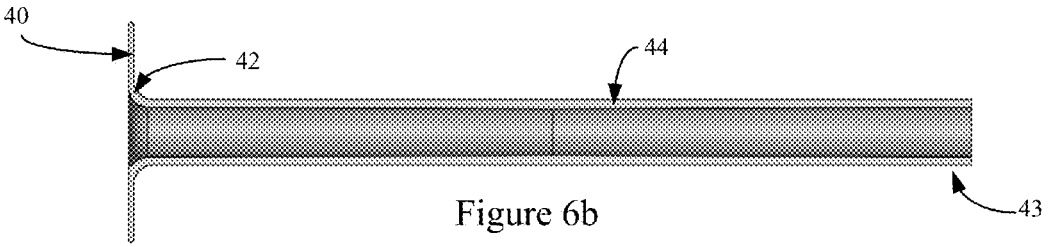
FIG. 6*b* of the drawings is a cross-sectional view of the hose spout of FIG. 6*a;*

At the distal end 43 of the elongated spout 44, the end may be open so as to allow fluid communication with the cavity 29. In other embodiments, as is shown in FIGS. 5*a* and 5*b*, the distal end 43 may be closed, wherein puncturing, cutting or the like will be required prior to dispensing. In other embodiments, a particular type of valve opening may be provided, such as particular scoring, or the like to provide a particular type of dispensing characteristics at the distal end. A number of different opening configurations are contemplated (in addition to that which is shown in FIGS. 6*a* and 6*b*, namely, a cross, snowflake or duckbill configuration to name a few).

Figure 8:
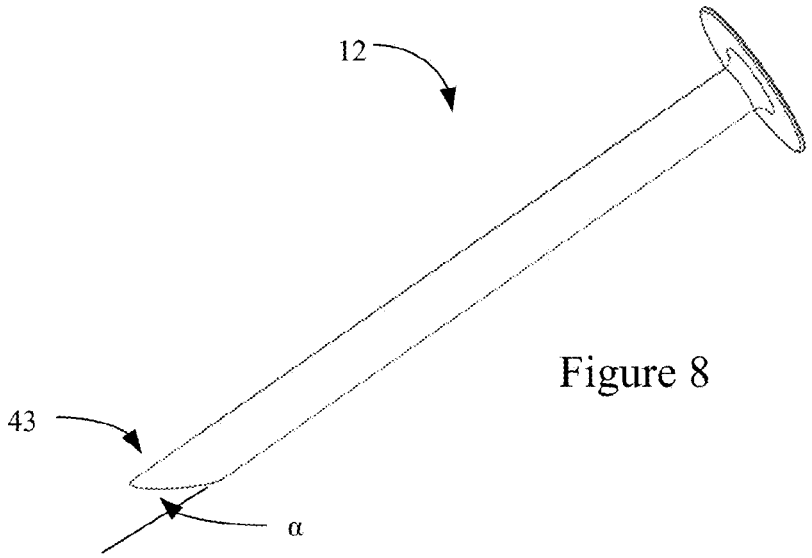
FIG. 8 of the drawings is a perspective view of a configuration of the hose spout of the present disclosure.
Figure 9:
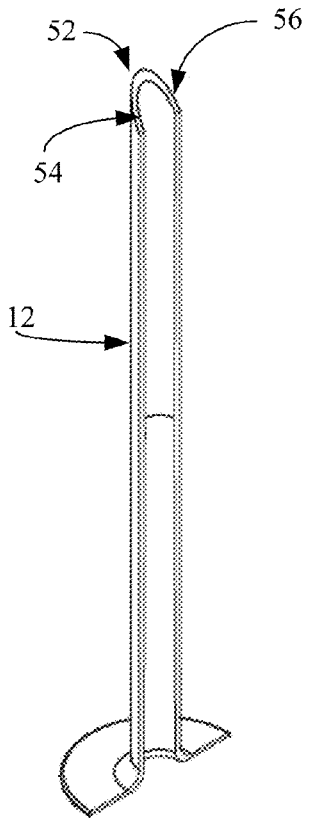
FIG. 9 of the drawings is a cross-sectional view of a configuration of the hose spout of the present disclosure.
Figure 10:
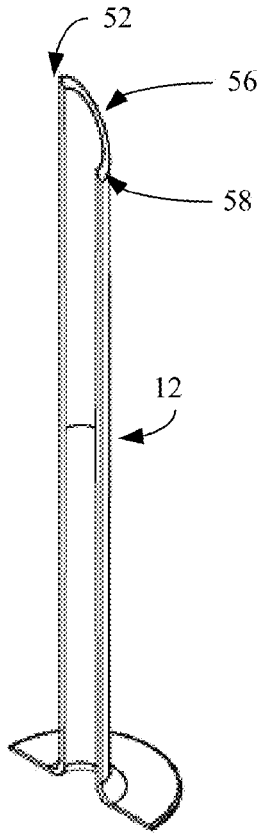
FIG. 10 of the drawings is a cross-sectional view of a configuration of the hose spout of the present disclosure.

In another embodiment of the disclosure, with reference to FIGS. 8 through 10, the distal end 43 is configured so as to include peak region 52 flanked by sides 54, 56 and opposite of valley region 58. In the embodiment shown, the distal end 43 is essentially formed at an oblique angle with respect to the axis of the spout, or at an angle relative to the flow therethrough. It will be understood that in different embodiments, the angles, such as angle $\alpha$, may be different, and may be varied due to variations in the spout. Angles of approximately 10° and 65° are contemplated, with a more preferred angle being between 15° and 40°, and more preferably approximately 30°. In the embodiment shown, the peak region is curved so as to present a pointed surface that is generally free of sharp edges and the like. It will be understood that the distal end 43 is substantially centered and uniform, however other variations are contemplated. The distal end 43 is oriented, preferably, so that the peak region 52 coincides with the top of the bag with the valley region 58 coinciding with the bottom of the bag. Preferably, the peak region 52 is positioned to coincide with the upper opening, although an offset or slightly twisted configuration is likewise contemplated. In this manner, the peak region 52 is preferably contacting a downward bend in a valve dispensing member before another portion of the hose.

In operation, the user is typically utilizing such a bag within a vessel or urn 100 configured to dispense fluid through valve dispensing member 102. Often, it is desirable to provide a urn and dispensing member that can be reused without being in contact with the product to be dispensed. The product only contacts the interior cavity of the bag and the elongated passage of the hose spout. In that manner, as desired, the bag can be replaced without the need to clean or sanitize the vessel and the valve dispensing member.

To prepare the urn for use in an embodiment of FIG. 7, the user first inserts the bag and hose spout into the inner cavity 104 of the vessel 100. The bag is directed downward with the hose spout 12 being directed into the valve dispensing member 102. It will be understood that the valve dispensing member 102 operates by selectively pinching and releasing the elongated spout, as desired. Such valves are well known in the art, and without limitation, such a valve is disclosed in U.S. Pat. No. 3,976,277 issued to Basel et al., which is also incorporated by reference in its entirety. Of course, other valve structures are likewise contemplated for use.

With the embodiment of FIGS. 8 through 10, as the hose spout is directed into the valve dispensing member 102, the distal end 43 essentially functions as the guide therethrough. It has been found that the ease of passage through the valve dispensing member 102 can be achieved through the configuration shown in these drawings. In such an embodiment, the peak region 52 contacts the valve dispensing member 102, generally at a bend. As the bends are generally in a downward direction, the peak region 52 is configured to coincide with the upper end of the bag, and thus, is the point of contact with a downwardly directed bend. Such a configuration of the distal end 43 precludes the jamming of the hose through the valve dispensing member and facilitates the smooth passage therethrough.

Once the bag is positioned within the vessel, and the hose spout is directed through the valve dispensing member, the upper perimeter of the bag can be extended up and over the upper edge 106 of the vessel and over the outside of the vessel. In an embodiment wherein the bag has a top seal, the bag can be cut or otherwise slit below the top seal and the top seal can be discarded, resulting in an open top bag. A rubber band, or other structure can be utilized over the bag to sandwich the bag between the rubber band and the outside surface of the vessel. In other embodiments, the respective size of the bag and dimension of the bag relative to the vessel will allow the bag to remain in the overlying orientation. In still other embodiments, an adhesive may be utilized.

Next, the user can insure that the distal end of the elongated spout 44 is prepared for dispensing. That is, if the distal end is closed, the user can cut or otherwise secure an opening on the distal end. In embodiments that already have an open end, this is not necessary. Additionally, prior to filling, the user should insure that the valve dispensing member is in the proper orientation, that is, that it is in the off position so that the fluid that is being introduced into the bag does not undesirably exit through the hose spout.

Once prepared, the user can introduce the desired fluid into the cavity of the bag. In certain embodiments, the ready to serve fluid can be placed directly into the bag. In other embodiments, the user may use the bag as a mixing chamber, wherein different constituents can be separately introduced and mixed within the bag. Once mixed, they can be dispensed.

Advantageously, due to the configuration of the hose spout, the spout is generally free from binding or otherwise being undesirably pinched while being inserted and properly positioned. In addition, the flexibility of the flange further facilitates the positioning of the bag in an orientation that is most conducive for dispensing. In addition, the flexibility of the flange also helps to preserve the integrity of the flange to bag, that is, bag to spout, connection regardless of the orientation and positioning within the vessel. Moreover, by having the entire structure of a flexible material, damage to adjacent bags due to shipping and handling can be minimized.

The foregoing description merely explains and illustrates the invention and the invention is not limited thereto except insofar as the appended claims are so limited, as those skilled in the art who have the disclosure before them will be able to make modifications without departing from the scope of the invention.

What is claimed is:

1. A flexible package for positionable within a vessel having an outlet controlled by a valve dispensing member, the flexible package comprising:

a dispensing bag including at least one panel and at least one seal defining a cavity with an open top, and an opening extending through the at least one panel spaced apart from the open top;

a hose spout comprising a monolithic member and including an integrally molded flange and elongated spout of a uniform material, the elongated spout extending from the molded flange and together defining an elongated channel with a proximal end and a distal end, the proximal end corresponding to the molded flange, the molded flange having an inner surface, the inner surface being coupled to the dispensing bag in sealed engagement about the opening thereof, and having an integrally molded transition region straddling the integrally molded flange and the elongated spout, the integrally molded transition region defining a filleted radius between the molded flange and the elongated spout, so as to define a smooth, continuous outer and inner surface.

2. The flexible package of claim 1 wherein the hose spout comprises a material of rigidity greater than that of the at least one panel, to, in turn, facilitate the extension of the hose spout through a valve dispensing member.

3. The flexible package of claim 2 wherein the dispensing bag includes a front panel and a back panel which are coupled together through by way of the at least one seal, with the open top being defined by opposing edges of the front panel and the back panel.

4. The flexible package of claim 3 wherein the front panel and the back panel comprises generally rectangular configurations, with the at least one seal including a first side seal, a second side seal opposite the first side seal and a bottom seal extending between the first side seal and the second side seal, and with the open top being defined by the front panel and the back panel between the first side seal and the second side seal opposite the bottom seal.

5. The flexible package of claim 4 wherein the opening is positioned between the open top and the bottom seal on the front panel, closer to the bottom seal than the open top.

6. The flexible package of claim 5 wherein the inner surface of the integrally molded flange is positioned entirely on the front panel.

7. The flexible package of claim 4 wherein the elongated spout extends substantially perpendicularly from the molded flange and substantially perpendicular from the front panel of the dispensing bag, with the dispensing bag being positioned on the back panel.

8. The flexible package of claim 1 wherein the distal end of the elongated channel defined by the elongated spout defines a peak region, that is configured to form a guide upon insertion of the elongated spout through a valve dispensing.

9. The flexible package of claim 8 wherein the distal end is formed at an oblique angle relative to an axis of the elongated spout.

10. The flexible package of claim 9 wherein the distal end further includes a valley region opposite the peak region, and sides extending therebetween.

11. The flexible package of claim 8 wherein the peak region is aligned with the top opening of the flexible bag.

12. The flexible package of claim 1 further including a transition region between the flange and the elongated spout, with the elongated spout having a substantially circular cross-sectional configuration.

13. The flexible package of claim 1 wherein the flange of the spout is coupled directly to the at least one panel of the dispensing bag.

14. A combination urn and flexible package comprising:

a urn including an upper edge defining an opening, and an inner cavity defined by an inner surface, a valve dispensing member provides fluid communication to the inner cavity spaced apart from the opening toward a lower portion of the urn, the valve dispensing member including an elongated opening; and a flexible package including:

a dispensing bag including at least one panel and at least one seal defining a cavity with an open top, and an opening extending through the at least one panel spaced apart from the open top;

a hose spout comprising a monolithic member, and including an integrally molded flange and elongated spout of a uniform material, the elongated spout extending from the molded flange and together defining an elongated channel with a proximal end and a distal end, the proximal end corresponding to the molded flange, the molded flange having an inner surface, the inner surface being coupled to the dispensing bag in sealed engagement about the opening thereof, and having an integrally molded transition region straddling the integrally molded flange and the elongated spout, the integrally molded transition region defining a filleted radius between the molded flange and the elongated spout, so as to define a smooth, continuous inner and outer surface, wherein the elongated spout of the hose spout is directed through the elongated opening of the urn upon positioning of the flexible package within the inner cavity of the urn, with the open top of the flexible package corresponding to the opening of the urn, and with the outer surface of the flange being abuttingly positionable against the inner surface.

15. The combination urn and flexible package of claim 14 wherein the open top of the flexible package is extended above and over the upper edge of the urn.

16. The combination urn and flexible package of claim 14 wherein the elongated spout further includes a peak region at the distal end thereof, the peak region configured to direct the elongated spout through the elongated opening of the valve dispensing member.

17. The combination urn and flexible package of claim 16 wherein the peak region is configured to facilitate the rotation of the elongated spout relative to the elongated opening of the valve dispensing member.

18. The combination urn and flexible package of claim 14 wherein the hose spout is coupled directly to the dispensing bag.

19. The combination urn and flexible package of claim 18 wherein the hose spout is formed from a first material and the dispensing bag is formed from a second material, wherein the second material is different from the first material.

* * * * *